United States Patent [19]

Meehan

[11] Patent Number: 4,941,574

[45] Date of Patent: Jul. 17, 1990

[54] PACKAGE FOR A LIQUID SAMPLE AND AN ASSOCIATED METHOD FOR PACKAGING A LIQUID SAMPLE

[76] Inventor: Frank Meehan, 203 Cathedral Ave., Hempstead, N.Y. 11550

[21] Appl. No.: 392,343

[22] Filed: Aug. 11, 1989

[51] Int. Cl.[5] ..... B65D 75/28

[52] U.S. Cl. ..... 206/466; 53/449; 53/455; 206/484; 206/732

[58] Field of Search ..... 206/521, 461, 466, 464, 206/463, 476, 484, 633, 632, 631, 45.31, 45.34, 469; 53/449, 455, 412; 383/106, 108

[56] References Cited

U.S. PATENT DOCUMENTS

| | | | |
|---|---|---|---|
| 1,719,962 | 7/1929 | Beistle | 206/45.31 |
| 2,195,577 | 4/1940 | Miles | 206/461 |
| 2,318,850 | 5/1943 | Grant | 206/45.31 |
| 2,352,319 | 6/1944 | Harris | 206/45.31 |
| 2,780,353 | 2/1957 | Volckening | 206/466 |
| 3,155,236 | 11/1964 | Reno | 206/45.34 |
| 3,334,804 | 8/1967 | Watts, Jr. | 206/463 |
| 3,540,583 | 11/1970 | Tomlinson | 206/466 |
| 3,917,116 | 11/1975 | Mason | 206/631 |
| 4,378,876 | 4/1983 | Szabo et al. | 206/45.34 |
| 4,430,843 | 2/1984 | Favale | 206/463 |

FOREIGN PATENT DOCUMENTS

| | | | |
|---|---|---|---|
| 3607012 | 10/1987 | Fed. Rep. of Germany | 206/461 |
| 1138689 | 12/1955 | France | 206/484 |
| 0977740 | 12/1964 | United Kingdom | 206/461 |

*Primary Examiner*—Jimmy G. Foster

*Attorney, Agent, or Firm*—Ladas & Parry

[57] ABSTRACT

A package and packaging method for a liquid sample in which the liquid sample is sealed in a flexible envelope of film material and the envelope is in turn supported in a protective enclosure having greater rigidity than the envelope. The envelope is engaged around a portion of its perimetral extent to leave the envelope exposed outside the engaged portion and free and unsupported along the remaining portion of its perimetral extent. The protective enclosure is thicker than the envelope so that the envelope is recessed and confined between the outer surfaces of the protective enclosure. The envelope is removed from the enclosure by manually engaging the exposed portion and pulling with sufficient force to overcome the support of the envelope by the enclosure.

28 Claims, 1 Drawing Sheet

PACKAGE FOR A LIQUID SAMPLE AND AN ASSOCIATED METHOD FOR PACKAGING A LIQUID SAMPLE

FIELD OF THE INVENTION

The invention relates to a package for a liquid sample and to a method for packaging a liquid sample.

DESCRIPTION OF PRIOR ART

There are many circumstances in which it is desirable to furnish liquid samples to the general public in an amount sufficient to allow more than one application. Commonly, and despite very high cost, the liquid sample is contained in a small vial attached to a printed card and frequently distributed at points of sale, This type of sample is rarely used in direct mail because it requires special packaging at considerable additional expense. Its bulk and fragility preclude its use as an insert in magazines.

It is known to furnish samples, for example of perfumes, as part of brand advertisements in magazines. Magazine samples are generally comprised of microencapsulated liquid in one of a number of formats that require suitable activation, such as rubbing, scratching, or tearing. In the course of delivery to the home, the magazine is subjected to handling which causes a large number of capsules to rupture, effectively prematurely activating any samples contained therein. Hence, when there are two or more different samples in the same magazine, it may not be possible to distinguish the individual odor of any one sample. Not only are the samples thereby rendered useless, but should the samples be activated to any great extent, the collective residue causes the entire magazine to smell.

Another major form of perfume promotion is enclosures in department store billing. These often include samples of the above-described micro-encapsulation type but also may be in "blotter" form. Namely, paper blotters are impregnated with liquid and then placed in a wrapper of cellophane or plastic which prevents the liquid, but not the odor, from permeating the entire enclosure.

Heretofore, there has not been any satisfactory production of a package which will enable a liquid sample to be contained in a flat package in protected fashion so that it can be sent through the mail, for example, as a promotional item in a magazine.

In my earlier U.S. Pat. Nos. 4,567,613 and 4,633,533, I have disclosed various articles and methods for dispensing liquids but I have not disclosed any method or means whereby a small sample of liquid can be incorporated in a liquid state in a package which is readily handled and which protects the sample.

In my co-pending application Ser. No. 318,909, I have disclosed an article in which a liquid sample can be self-contained, however, the article is capable of being crushed and allowing leakage of the sample.

SUMMARY OF THE INVENTION

An object of the invention is to provide a method in which a small liquid sample, such as a perfume, can be packaged for subsequent sampling by a user.

A further object of the invention is to provide a package for such a liquid sample in which the liquid is visible.

Yet another object of the invention is to provide a method by which the liquid sample is contained in a flexible envelope which has a protective enclosure which enables the package to be manually manipulated while isolating the package from application of squeezing forces on the envelope.

Another object of the invention is to provide a method in which the envelope containing the liquid sample can be readily disconnected from the protective enclosure.

Another object of the invention is to permit the envelope containing the liquid sample to be easily opened after disconnection from the enclosure.

Another object of the invention is to permit the easy opening of the envelope without spillage or misapplication of the liquid. According to a feature of the invention, the envelope can be opened by unpeeling one layer of the envelope from another.

Another object of the invention is to provide a method in which the liquid sample can be packaged in an inexpensive and simple manner.

Another object of the invention is to provide a package for a liquid sample which will be only a fraction of the cost of a glass or plastic vial.

Another object of the invention is to provide a package for a liquid sample in which the liquid sample is protected so that the package can be sent through the mail especially as an insert in a magazine without release of the liquid or its scent.

Another object of the invention is to provide a package in which the envelope containing the liquid sample is removed from the enclosure before the user opens the envelope to gain access to the liquid sample. Thereby, when the package is included as an insert in a magazine, no odor will be produced until the user removes and opens the envelope. Consequently, a number of samples can be sent together without any danger of commingling of odors thereby preserving the integrity of the samples.

In accordance with the above and further objects of the invention, a method is provided in which a liquid sample is sealed in an envelope of non-permeable film material and the envelope is supported in a protective enclosure having greater rigidity than the envelope by engaging the envelope around a portion of its perimetral extent to leave the envelope exposed outside the engaged portion and free and unsupported along its remaining perimetral portion, the protective enclosure being of a thickness so that the envelope will be recessed below the outer surfaces of the enclosure.

In further accordance with the invention, the envelope is removed from the enclosure by manually engaging the exposed portion of the envelope and pulling with sufficient force to overcome the support of the envelope by the enclosure.

In further accordance with the invention, the envelope is supported within the enclosure by sandwiching the engaged portion of its perimetral extent between two layers of the material of the enclosure, said layers being flat and holding the envelope in flat coplanar relation with the enclosure.

A further object of the invention is to provide a package for a liquid sample in which the envelope containing the liquid sample will be accessible and at the same time protected so that it can be enclosed as a promotional item, for example, in a magazine.

The invention contemplates for this purpose a package which comprises a sealed envelope of non-odor permeable film material sealably containing a liquid sample and protective support means detachably engaging said envelope around at least a portion of the perimetral extent thereof for holding the envelope in a flat state recessed below outer surfaces of the support means. A free and unsupported remaining portion of the envelope is manually engageable for detachably removing the envelope from the support means.

If the liquid sample is to be visible, the envelope is made from a transparent plastic material.

The support means has an opening across which the envelope extends, and preferably the opening is in the form of a cutout so that the envelope with the liquid sample contained therein is visible and engageable in the cutout. Preferably, the envelope is confined so that it lies within the perimetral outline of the support means.

According to a particular feature of the invention, the support means comprises a substrate including opposed flaps which detachably secure the envelope therebetween in sandwiched condition along that portion of the perimetral extent of the envelope which is engaged by the support means. Preferably this represents a major portion of the perimetral extent of the envelope so that the minor portion of the perimetral extent of the envelope is free and unsupported.

The total thickness of the substrate where the flaps engage the envelope is greater than the combined thickness of the envelope and the liquid sample so that the envelope is recessed beneath the outer surfaces of the flaps.

DETAILED DESCRIPTION OF A PREFERRED EMBODIMENT

Figure 1:
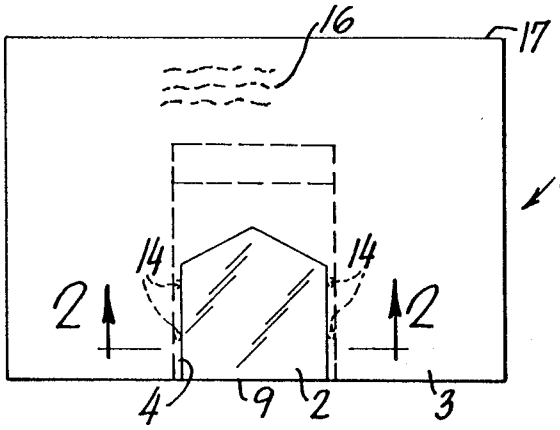
FIG. 1 is a plan view of a package for a liquid sample according to the invention.

In the drawing, there is seen a package 1 for a liquid sample which comprises a flat sealed envelope 2 containing the liquid sample and a protective enclosure 3 in which the envelope 2 is supported. The protective enclosure 3 is also of substantially flat configuration and is made of a material having substantially greater rigidity than that of the envelope 2. In one embodiment, the envelope 2 is made of a relatively thin transparent plastic material while the protective enclosure is a thicker substrate made of a more rigid material, such as cardboard or other heavy paper product.

Figure 2:
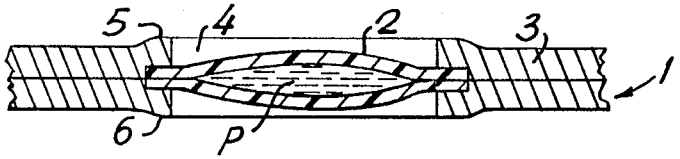
FIG. 2 is a sectional view on enlarged scale taken along line 2—2 in FIG. 1.

In the assembled state of the package as shown in FIGS. 1 and 2, the envelope 2 is engaged within and enclosed by the protective enclosure 3 in a condition in which a portion of the envelope 2 is visible through a cutout 4 formed in the enclosure. Due to the construction in which the protective enclosure is of greater thickness than the envelope, the outer surfaces 5 and 6 of the enclosure are spaced respectively above and below the envelope to provide protection for the envelope and its liquid sample. This will be explained more fully later.

Figure 3:
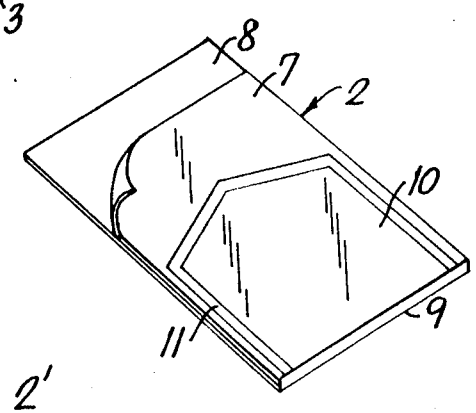
FIG. 3 is a perspective view on enlarged scale of a sealed envelope containing liquid used in the package.

The envelope is formed as shown in FIG. 3 by overlapping two flaps 7,8 on one another around a fold line 9. A pocket 10 for containing a liquid sample P in sealed relation is formed by sealing the overlapped flaps 7 and 8 along a seal line 11 formed by heat sealing the flaps along line 11. The seal line 11 extends from the fold line 9 along a path which corresponds to the outline of the cutout 4 in the enclosure. In the assembled state therefore, the pocket 10 will be exposed through the cutout 4. If the envelope 2 is made of transparent material, the liquid sample which is contained in the pocket will be visible through the cutout.

The envelope can be made of any suitable plastic material which is non permeable to liquids and their scents and is capable of being sealed. The choice is widespread and those skilled in the art will readily be able to select appropriate materials for use depending on the nature of the liquid sample and the general requirement that the plastic material not interfere with the long term storage of the liquid sample nor impair the properties thereof. In the case of perfumes, it is important that the plastic material not interfere with the scent of the perfume. By way of example, the material of the envelope can be a polyethylene film sold by the 3-M Company under the trademark "Scotch-Pak #122". This material can be heat sealed along sealing line 11 and can be peeled open after heat sealing. This material is substantially impermeable to liquids and their odor and will not affect the scent of perfumes or like liquids when stored in the envelope.

Figure 4:
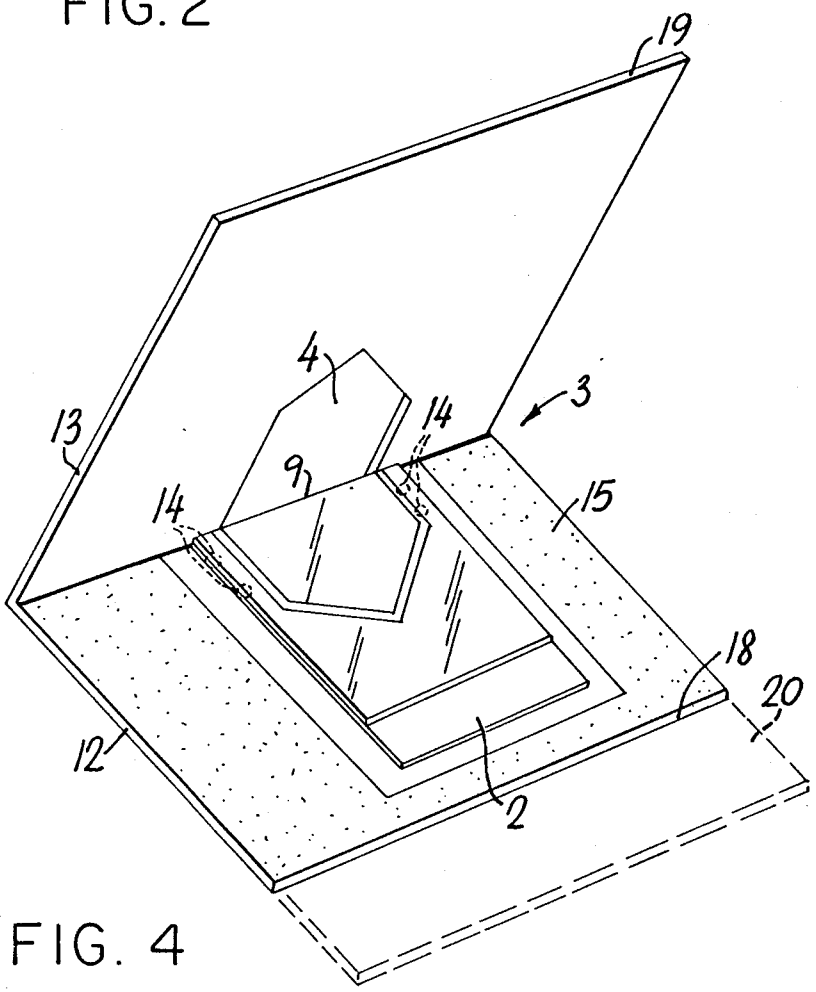
FIG. 4 is a perspective view showing an intermediate stage in the assembly of the package.

In order to assemble the package for use, the liquid sample is deposited onto the envelope in an amount which can be adsorbed by the envelope. The liquid sample is then sealed in the envelope 2 by folding the envelope along fold line 9 and forming the heat seal along line 11. The envelope 2 containing the liquid sample is then placed on one layer or flap 12 of the protective enclosure which, as seen in FIG. 4, is foldably connected to an upper layer or flap 13. The envelope is lightly secured to the enclosure by a number of adhesive dots 14 placed adjacent to the heat seal in proximity to the edges of the envelope. The adhesive dots 14 can be disposed between the envelope and one or both flaps 12 and 13. The purpose of the adhesive dots is to hold the envelope in a supported condition in the enclosure with only a relatively weak attachment strength so that when the envelope is to be separated from the enclosure, the envelope can be pulled from the enclosure while remaining intact. It has been found particularly effective, for this purpose, to place the adhesive dots 14 in the narrow margin of the envelope between seal line 11 and the edges of the envelope.

In the assembled condition, the envelope is sandwiched between the flaps 12 and 13 and the flaps engage the envelope over a portion of its perimetral extent in order to leave the pocket 10 exposed through the cutout 4 while the remaining portion of the perimetral extent of the envelope represented by the edge 9 remains free and unsupported.

In order to remove the envelope from its protective enclosure, the user grasps the visible portion of the envelope, i.e. the pocket 10, and exerts a pulling force to overcome the attachment provided by the adhesive dots 14 to release the envelope from the package. By virtue of the strength and flexibility of the material of the envelope, it is readily separable from the enclosure while remaining intact. In order to seal the flaps 12 and 13 of the protective enclosure and to permit the envelope to be removed from the enclosure by the aforedescribed pulling action, the lower flap 12 can be coated with an adhesive in a region 15 surrounding the envelope. Any adhesive suitable for securing the material of the flaps of the enclosure can be employed. Moreover, the adhesive can be placed on either or both flaps.

After the envelope has been removed from the protective enclosure, the flap 7 can be peeled back as shown in FIG. 3 with sufficient force to open the heat seal 11 to provide access to the liquid sample within the pocket 10. Since the sample in liquid form is adsorbed on the envelope material in the pocket 10, it remains in place. The liquid sample is applied by using the envelope as an applicator or by transferring the sample from the envelope to the user by his or her finger.

Since the protective enclosure has a greater length and width than the envelope, it is possible to print indicia 16 on the package which can be of an informative or advertising nature.

FIG. 2 shows the arrangement of the envelope in the enclosure. In the illustrated embodiment, the thickness of the material of the enclosure is 0.008" and the thickness of the film of the envelope is 0.002". Therefore, the total thickness of the package where the envelope is sandwiched between the flaps of the enclosure is 0.020". The liquid sample P and any accompanying air in the envelope causes the pocket 10 to have an overall thickness of about 0.016"–0.018". Hence, the thickness of the protective enclosure at surfaces 5 and 6 where it sandwiches the edge of the envelope is greater than the maximum overall thickness of the pocket and thereby the enclosure can protect the envelope from application of squeezing forces by intercepting these forces at surfaces 5, 6. Effectively, the surfaces 5, 6 extend around the sandwiched perimeter of the envelope and form a thickened rim around the cutout to protect the envelope against application of squeezing forces. This enables the package to be used as an insert card in a magazine. The envelope is held in co-planar relation with the enclosure by the mating flaps of the enclosure and will not be subjected to squeezing forces even when a large number of magazines are stacked one on top of the other, for example, during production and shipping. The recessed position of the envelope 2 with respect to the outer surfaces 5 and 6 of the protective enclosure make this possible. The envelope is further protected by the protective enclosure by maintaining the edge 9 of the envelope within the outline of the enclosure. In the drawing, the edge 9 of the envelope is rectilinear and is substantially coincident with the edge of the enclosure, but it is also possible for the edge of the envelope to be substantially recessed with respect to the edge of the protective enclosure. Instead of a rectilinear edge, the enclosure can have any other suitable shape.

If it is desired to supply a number of liquid samples which can be the same or different, the enclosure can be provided with a plurality of cutouts in which a respective envelope can be engaged. Alternatively, the pocket 10 can be divided into two chambers by providing a transverse seal line 11 across the pocket. In this way the same or different liquid samples can be incorporated in the respective chambers. In use, the user peels back the flap 7 to peel open the seal line bounding the first chamber to gain access to the liquid sample therein after the liquid sample has been used, the remainder of the seal line can be unpeeled to expose the liquid sample in the second chamber.

In accordance with the invention, there has been provided a package 1 in which the flexible normally non-self-sustaining envelope 2 is supported with stability in the enclosure in a position in which the envelope is engaged over a portion of its perimetral extent while the remaining perimetral portion of the envelope is free and unsupported, the pocket 10 containing the liquid sample being confined in the cutout 4 in recessed relation below the outer surfaces 5, 6 so that the envelope is protected by the enclosure and is capable of being manually engaged to detach the envelope from the protective enclosure.

As illustrated, the package 1 is adapted for incorporation into a book, magazine or pamphlet by side wire binding or perfect binding in which edge 17 of the enclosure is affixed in the binding. Edge 17 is formed by aligned edges 18 and 19 of flaps 12 and 13. The package 1 can also be affixed by saddle wire binding by extending flap 12 beyond edge 18, as shown in dotted outline at 20 in FIG. 4, and forming a fold in the extended flap 12 at or near edge 18.

Although the invention has been described in relation to specific embodiments thereof, and has been generally described with reference to liquid perfume samples, it will become apparent to those skilled in the art that numerous modifications and variations can be made as regards the composition of the enclosure, the liquid sample, and the envelope within the scope and spirit of the invention as defined in the attached claims. For example, the liquid sample could be a medicament or reagent of a specific dosage useful for therapeutic or testing purposes.

Figure 5:
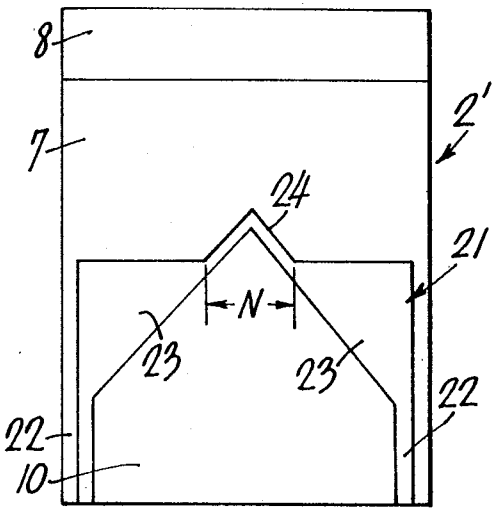
FIG. 5 is a plan view of another embodiment of an envelope suitable for a relatively viscous flowable product.

In the event that the sample is a flowable product such as a lotion, cream or paste, the envelope can be modified to permit discharge of the sample through a small calibrated passage by a squeezing action on the pocket. FIG. 5 shows an embodiment suitable for a flowable product, such as a lotion, cream or paste which is similar to FIG. 3 and in which the same reference characters are used to designate the same parts. In FIG. 5 there is seen an envelope 2' formed by folded flaps 7,8 which are secured by a heat seal 21 formed by seal lines 22 which merge into relatively large triangular seal areas 23 from which extend seal lines forming a triangular peak 24.

The envelope 2' is mounted in the enclosure 3 in the same manner as described for the embodiment shown in FIG. 3, namely by means of adhesive dots and by being sandwiched between flaps 12 and 13 of the enclosure. When the envelope 2' is removed from the enclosure, access to the flowable product is obtained by lifting flap 7 away from flap 8 and forming an opening for the pocket 10 by peeling the flap 7 away from flap 8 at the peak 24. The opening will be formed at the base of peak 24 with a width N. The presence of the triangular seal areas 23 provides a resistance to the separation of flap 7. Consequently, when the flap 7 is lifted only the triangular peak 24 will be unpeeled and provide the outlet opening for the contents in pocket 10.

What is claimed is:

1. A package for a liquid sample comprising a sealed envelope containing a small quantity of liquid, said envelope including seal means which can be peeled open to provide access to said liquid, said envelope being relatively flat and thin, a flat protective enclosure for said envelope, said envelope being engaged within and enclosed in said enclosure, said enclosure having an opening through which said envelope is visible and engageable, and means releasably connecting said envelope in said enclosure such that upon engaging said envelope at said opening and applying a force to the envelope, the connecting means can be overcome and said envelope can be removed from the enclosure in intact sealed state, said enclosure being of a thickness to provide outer surfaces which extend beyond the envelope and protect the envelope.

2. A package as claimed in claim 1 wherein said envelope is made from a plastic material.

3. A package as claimed in claim 2 wherein said enclosure engages said envelope along a portion of the perimetral extent of the envelope and leaves a remaining portion of the envelope free and unsupported.

4. A package as claimed in claim 3 wherein said enclosure has an opening in which said envelope extends.

5. A package as claimed in claim 4 wherein said envelope has an edge extending across said opening in the enclosure.

6. A package as claimed in claim 5 wherein said enclosure is a paper product.

7. A package as claimed in claim 5 wherein said opening is formed in said enclosure by a cutout.

8. A package as claimed in claim 7 wherein said enclosure has a perimetral outline within which said envelope is confined.

9. A package as claimed in claim 8 wherein the free and unsupported portion of the envelope has an edge which is substantially coincident with the outline of the enclosure.

10. A package as claimed in claim 9 wherein said outline includes a rectilinear portion.

11. A package as claimed in claim 1, said envelope including openable sealing means.

12. A package for a liquid sample comprising a sealed envelope of film material containing a liquid sample, protective support means engaging said envelope around a portion of the perimetral extent of said envelope to leave a remaining portion of the envelope free and unsupported, said protective support means being relatively rigid compared to said envelope to hold said envelope with stability in a position in which said support means has outer surfaces between which said envelope is confined, and means for detachable separation of said envelope in intact sealed state from said support means by manually engaging said free and unsupported remaining portion of said envelope and detaching the envelope from the support means.

13. A package as claimed in claim 12 wherein said envelope is made from a transparent plastic material.

14. A package as claimed in claim 12 wherein said support means has an opening across which said envelope extends.

15. A package as claimed in claim 14 wherein said opening is a cutout in said support means.

16. A package as claimed in claim 15 wherein said support means has a perimetral outline within which said envelope is confined.

17. A package as claimed in claim 15 wherein said opening is a cutout in said support means.

18. A package as claimed in claim 17 wherein said support means has a perimetral outline within which said envelope is confined.

19. A package as claimed in claim 12, said envelope including openable sealing means.

20. A package for a liquid sample comprising a sealed envelope of film material containing a liquid sample, protective support means for said envelope comprising opposed flaps sandwiching said envelope therebetween along a major portion of the perimetral extent of said envelope to leave a minor portion of the perimetral extent of the envelope free and unsupported, said support means being relative rigid compared to said envelope, and means detachably connecting said envelope to said support means at said major portion of the peritral extent of the envelope such that upon engaging said envelope at said opening and applying a force to the envelope, the connecting means can be overcome and the envelope can be separated from the support means in intact sealed state.

21. A package as claimed in claim 20 wherein said support means has an opening across which said envelope extends.

22. A package as claimed in claim 20 wherein said envelope is confined within the combined thickness of the opposed flaps and the sandwiched envelope therebetween.

23. A package as claimed in claim 20, said envelope including openable sealing means.

24. A package for a liquid sample comprising a flexible envelope including a pocket containing a liquid sample, relatively rigid support means engaging said envelope around at least a portion of the perimeter thereof and providing an opening in which the pocket of the envelope including the liquid sample is received in recessed relation below outer surfaces of the support means and means permitting separation of said envelope from said support means in intact sealed state by application of force to said envelope at said opening.

25. A package as claimed in claim 24 wherein said envelope includes openable sealing means which, when opened, provides an opening of determined size through which the liquid sample can be discharged.

26. A packaging method for a liquid sample comprising:

sealing a liquid sample in an envelope of film material;

detachably supporting said envelope in a protective enclosure having greater rigidity than the envelope by engaging the envelope around a portion of the perimetral extent of the envelope to leave the envelope exposed outside the engaged portion and free and unsupported along the remaining portion of its perimetral extent, providing the protective enclosure with a thickness such that the envelope is recessed below outer surfaces of the enclosure, and separating the envelope in intact state from the enclosure by manually engaging and pulling the exposed portion of the envelope to overcome the detachable support of the envelope by the enclosure.

27. A method as claimed in claim 26 wherein the envelope is supported by the enclosure by engaging the envelope at said portion of its perimetral extent, in sandwiched relation, between two layers of said enclosure.

28. A method as claimed in claim 27 wherein the layers of the enclosures are flat and hold the envelope in a flat condition.

* * * * *